US011333161B2

(12) United States Patent
Zhang et al.

(10) Patent No.: US 11,333,161 B2
(45) Date of Patent: May 17, 2022

(54) CURVED SURFACE PROCESSING METHOD FOR INLET EDGE OF CYLINDRICAL BLADE OF CENTRIFUGAL PUMP IMPELLER

(71) Applicant: Jiangsu University, Jiangsu (CN)

(72) Inventors: Qihua Zhang, Jiangsu (CN); Shun Kang, Jiangsu (CN); Weidong Zhang, Jiangsu (CN); Zhaoxu Yan, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/251,816

(22) PCT Filed: May 18, 2020

(86) PCT No.: PCT/CN2020/090769
§ 371 (c)(1),
(2) Date: Dec. 14, 2020

(87) PCT Pub. No.: WO2020/238669
PCT Pub. Date: Dec. 3, 2020

(65) Prior Publication Data

US 2021/0364007 A1 Nov. 25, 2021

(30) Foreign Application Priority Data

May 29, 2019 (CN) ..... 201910455788.8

(51) Int. Cl.
*F04D 29/24* (2006.01)
*F04D 29/22* (2006.01)

(52) U.S. Cl.
CPC ..... *F04D 29/22* (2013.01); *F04D 29/2216* (2013.01); *F04D 29/242* (2013.01); *F04D 29/2222* (2013.01)

(58) Field of Classification Search
CPC .... F04D 29/22; F04D 29/2216; F04D 29/242; F04D 29/2222
See application file for complete search history.

(56) References Cited

U.S. PATENT DOCUMENTS 5,620,306 A * 4/1997 Day ..... F04D 29/284 416/185
2016/0319822 A1* 11/2016 Niu ..... F04D 25/06

FOREIGN PATENT DOCUMENTS

CN 104314860 A * 1/2015
CN 105134646 12/2017
(Continued)

OTHER PUBLICATIONS

Van J Ing, et al. , "Research Into Some Cylindrical Blades", Drainage and Irrigation Machinery vol. 18 No. 1( Total No. 78), Jan. 15, 2000, pp. 1-5.

(Continued)

*Primary Examiner* — Sabbir Hasan
(74) *Attorney, Agent, or Firm* — JCIP Global Inc.

(57) ABSTRACT

A curved surface processing method for an inlet edge of a cylindrical blade of a centrifugal pump impeller includes following steps. A center of an impeller is used as a center to draw circles having respective diameters. A first point having a first distance from the center is determined on a concave side curve at a top of the blade, and a second point having a second distance from the center is determined on a concave side curve at a bottom of the blade. By improving the shape of a blade in an impeller, the angle of an inlet edge at the top of the blade is more close to the tangent direction, and the inlet angle of the top blade is reduced. A twisted surface is formed between a first arc segment at the top and a second arc segment at the bottom.

3 Claims, 5 Drawing Sheets

(56) References Cited

FOREIGN PATENT DOCUMENTS

| | | |
|---|---|---|
| DE | 10133936 | 1/2003 |
| GN | 201288694 | 8/2009 |
| GN | 104314860 | 1/2015 |
| GN | 110185654 | 8/2019 |

OTHER PUBLICATIONS

Wang Jian-Hua, et al., "Research of Molded Line for Cylindrical Blade of Low Speed centrifugal pump" Journal of Yangtze University (Nat Sci Edit) vol. 6 No. 3, Sep. 2009, pp. 1-4.
"International Search Report (Form PCT/ISA/210) of PCT/CN2020/090769," dated Aug. 13, 2020, pp. 1-4.
Guan Xingfan, "Modern Pump Technical Manual," with English translation of Summary thereof, 1st ed., 1995, pp. 1-816.

* cited by examiner

CURVED SURFACE PROCESSING METHOD FOR INLET EDGE OF CYLINDRICAL BLADE OF CENTRIFUGAL PUMP IMPELLER

CROSS-REFERENCE TO RELATED APPLICATION

This application is a 371 of international application of PCT application serial no. PCT/CN2020/090769, filed on May 18, 2020, which claims the priority benefit of China application no. 201910455788.8, filed on May 29, 2019. The entirety of each of the above mentioned patent applications is hereby incorporated by reference herein and made a part of this specification.

BACKGROUND

Technical Field

The present invention relates to the technical field of centrifugal pump impellers, and particularly to a curved surface processing method for an inlet edge of a cylindrical blade of a centrifugal pump impeller.

Description of Related Art

In the past, there was little focus on the issue of the design process of a blade inlet in the design of a centrifugal pump with cylindrical blades. In the design of a cylindrical blade, a top curve and a bottom curve of the blade coincide with each other. In the actual design, only one concave side curve and one convex side curve need to be drawn, for example, "or, draw only one middle curve, and specify a blade thickness along the curve" in page 229 of "Handbook of Modern Pump Technology", First Edition, 1995.

The journal article "Analysis and Research on Some Cylindrical Blades" in "Drainage and Irrigation Machinery" 2000, studied a method for drawing Archimedean spirals, arc lines, logarithmic spirals, and so on, and pointed out that several curves can be used for splicing and so on.

The journal article "Research on Cylindrical Blade Profile of Low Specific Speed Pump" in "Journal of Yangtze University (Natural Science Edition)", 2009, introduced a method for drawing a blade curve using a cubic polynomial.

Patent application number 201510527178.6 (publication of CN 105134646B) entitled "Method for Designing Cylindrical Blade with Controllable Inlet Setting Angle" uses a cylindrical blade curve designed by a spiral. An inlet angle can be set, and a curve can be drawn.

It is obvious that the top and bottom of the blade drawn in the aforementioned methods are the same curve.

However, the blade top and the blade bottom have different incoming flow conditions, and an incoming flow angle of the top is much smaller than an incoming flow angle of the bottom. Typically, a top curve and a bottom curve do not coincide with each other. This is the reason why double-curvature blades are used by most centrifugal pump impellers (double curvature means that a top curve and a bottom curve of a blade are different curves, which is also called a twisted blade). However, the double-curvature blades are spatially twisted, which brings difficulties to actual manufacturing and increases costs of mold making and casting. This is also the reason why cylindrical blades are selected for some pumps with low specific speeds and some small pumps with low costs. However, the use of cylindrical blades inevitably causes inadaptation of an inlet edge of a blade to an incoming flow angle, which usually results in an efficiency that is several percentage points lower than that of the impellers with twisted blades.

SUMMARY

In order to solve the aforementioned technical problems, the present invention provides a curved surface processing method for an inlet edge of a cylindrical blade of a centrifugal pump impeller. A top curve is extended in a tangential direction to decrease a blade angle. A curved surface of an inlet edge formed between the modified top curve and bottom curve has a twisted shape, but remains a cylindrical blade, which does not affect the mold and casting or injection molding production. Moreover, the inlet edge of the blade using the present method adapts to an incoming flow direction angle to a greater extent, which can improve the performance of the impeller.

In order to achieve the aforementioned purposes, the present invention provides the following solution.

The present invention provides a curved surface processing method for an inlet edge of a cylindrical blade of a centrifugal pump impeller, including the following steps.

Step 1: Using a center of an impeller with existing cylindrical blades as a center to draw a circle having a diameter D1 and a second circle having a second diameter D2, the circle having the first diameter D1 being an improved inlet position at a top of a blade, and the circle having the second diameter D2 being an improved inlet position at a bottom of the blade;

Step 2: Determining a point P1 having a first distance S1 from the center on a concave side curve at the top of the existing cylindrical blade, and determining a second point P2 having a second distance S2 from the center on a concave side curve at the bottom of the blade;

Step 3: Extending the concave side curve at the top of the existing cylindrical blade at the first point P1 in a tangential direction to draw a first arc segment R1, and then draw a third arc segment R3 at which the extended curve is tangent to a convex side curve.

Step 4: Extending the concave side curve at the bottom of the existing cylindrical blade at the second point P2 in a tangential direction to draw a second arc segment R2, and then draw a fourth arc segment R4 at which an extended curve is tangent to the convex side curve.

Step 5: Smoothly transitioning from the third arc segment R3 to the fourth arc segment R4 with an arc surface using the third arc segment R3 as a start and the fourth arc segment arc R4 as an end, to make a radius of the fourth arc segment R4 larger than a radius of the third arc segment R3, thereby forming a draft angle from the bottom of the blade to the top of the blade.

Optionally, the first distance S1=(1.1–1.3)×(D1)/2.

Optionally, the second distance S2=(1.1-1.3)×(D2)/2.

The present invention achieves the following technical effects over the prior art.

In the curved surface processing method for the inlet edge of the cylindrical blade of the centrifugal pump impeller in the present invention, the angle of the inlet edge at the top of the blade is allowed to be more tangential, and thus the inlet angle at the top of the blade is reduced. A twisted surface is formed between the first arc segment R1 at the top and the second arc segment R2 at the bottom. This twisting feature is beneficial to improve the adaptability of the inlet edge of the blade to flowing of the incoming flow. Meanwhile, the blade with the newly-constructed inlet edge is still the cylindrical blade, and is easy to draft.

BRIEF DESCRIPTION OF THE DRAWINGS

To illustrate the technical solutions in the embodiments of the present invention or in the prior art more clearly, the accompanying drawings to be used in the embodiments will be introduced briefly in the following. Apparently, the accompanying drawings in the following description are only some embodiments of the present invention, and those of ordinary skill in the art can obtain other drawings according to the accompanying drawings without creative efforts.

Description of reference signs: 1. convex side curve and concave side curve at top of blade; 2. convex side curve and concave side curve at bottom of blade; 3. inlet edge of blade; 4. convex side curve at top of blade; 5. concave side curve at top of blade; 6. twisted surface; 7. concave side curve at bottom of blade; 8. convex side curve at bottom of blade.

DESCRIPTION OF THE EMBODIMENTS

The technical solutions in the embodiments of the present invention will be clearly and fully described below with reference to the accompanying drawings in the embodiments of the present invention. It is obvious that the embodiments to be described are only a part rather than all of the embodiments of the present invention. All other embodiments derived by those of ordinary skill in the art based on the embodiments in the present invention without creative efforts should fall within the protection scope of the present invention.

Embodiment 1

Figure 1:
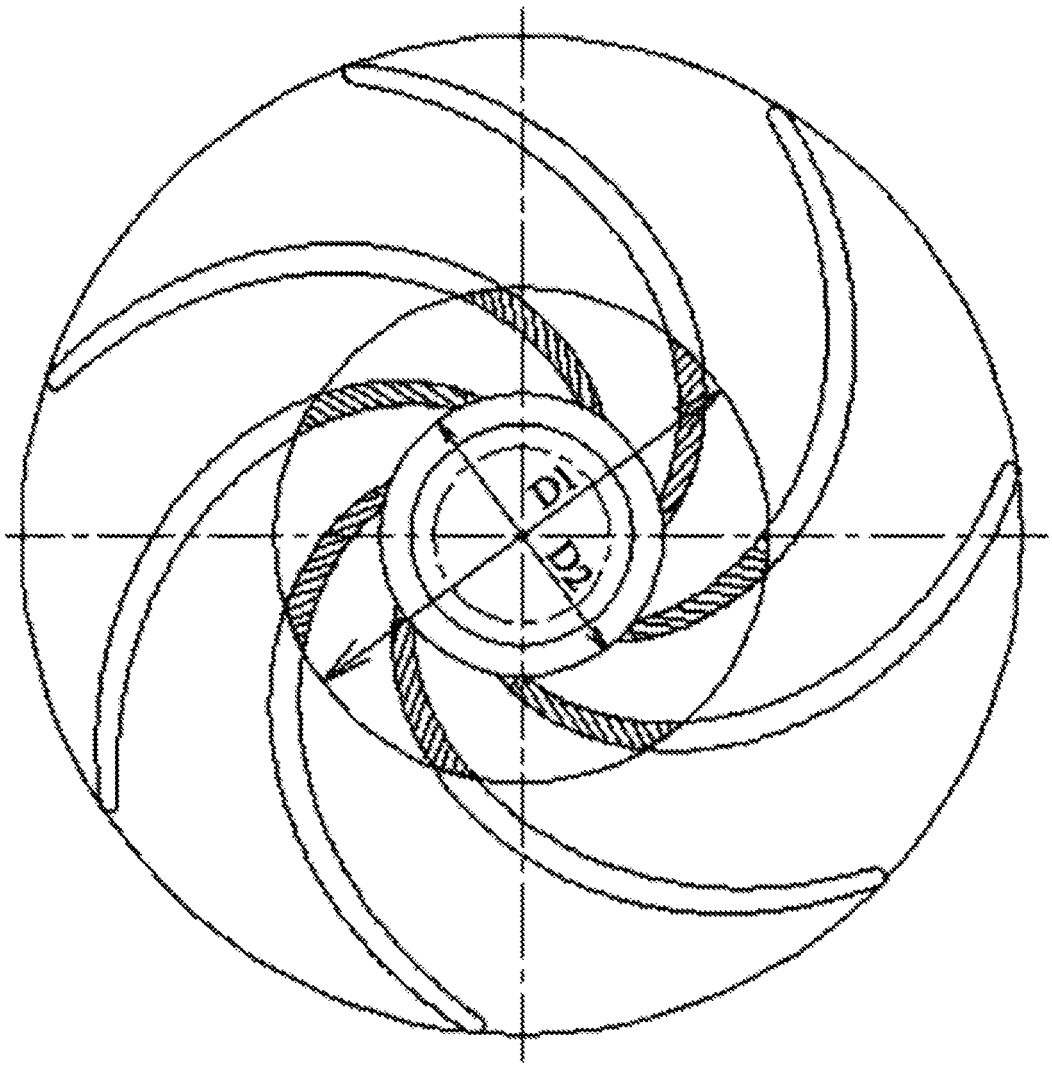
FIG. 1 is a schematic structural diagram of an impeller with existing cylindrical blades.
Figure 2:
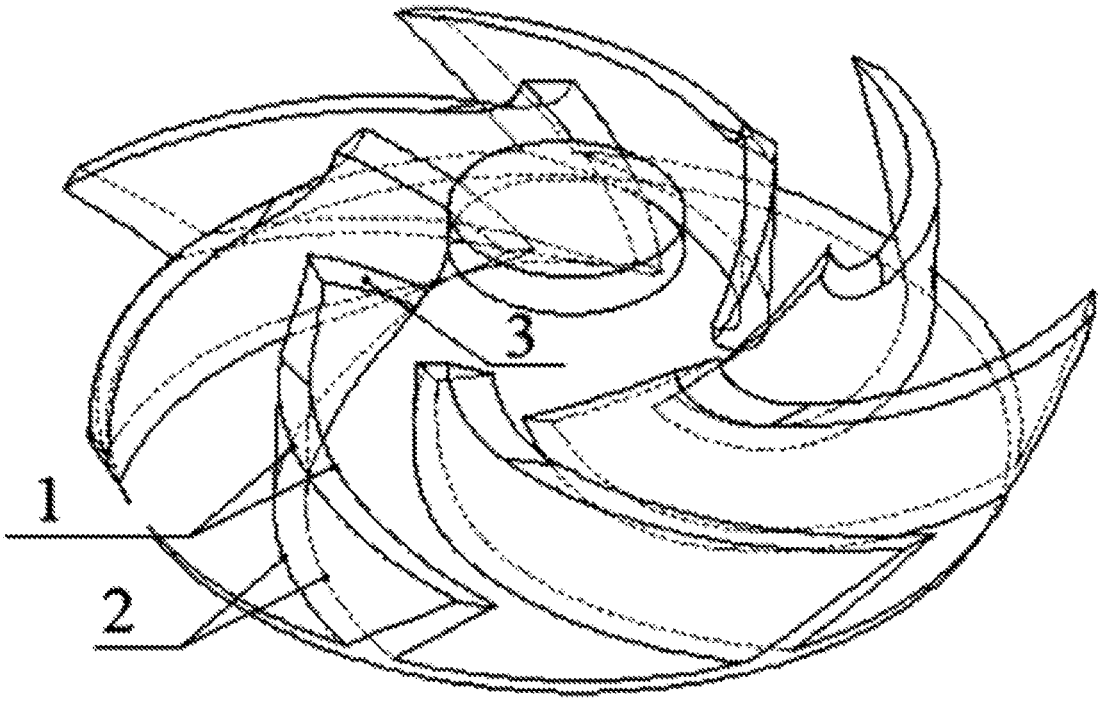
FIG. 2 is a schematic three-dimensional structural diagram of the impeller with the existing cylindrical blades.
Figure 3:
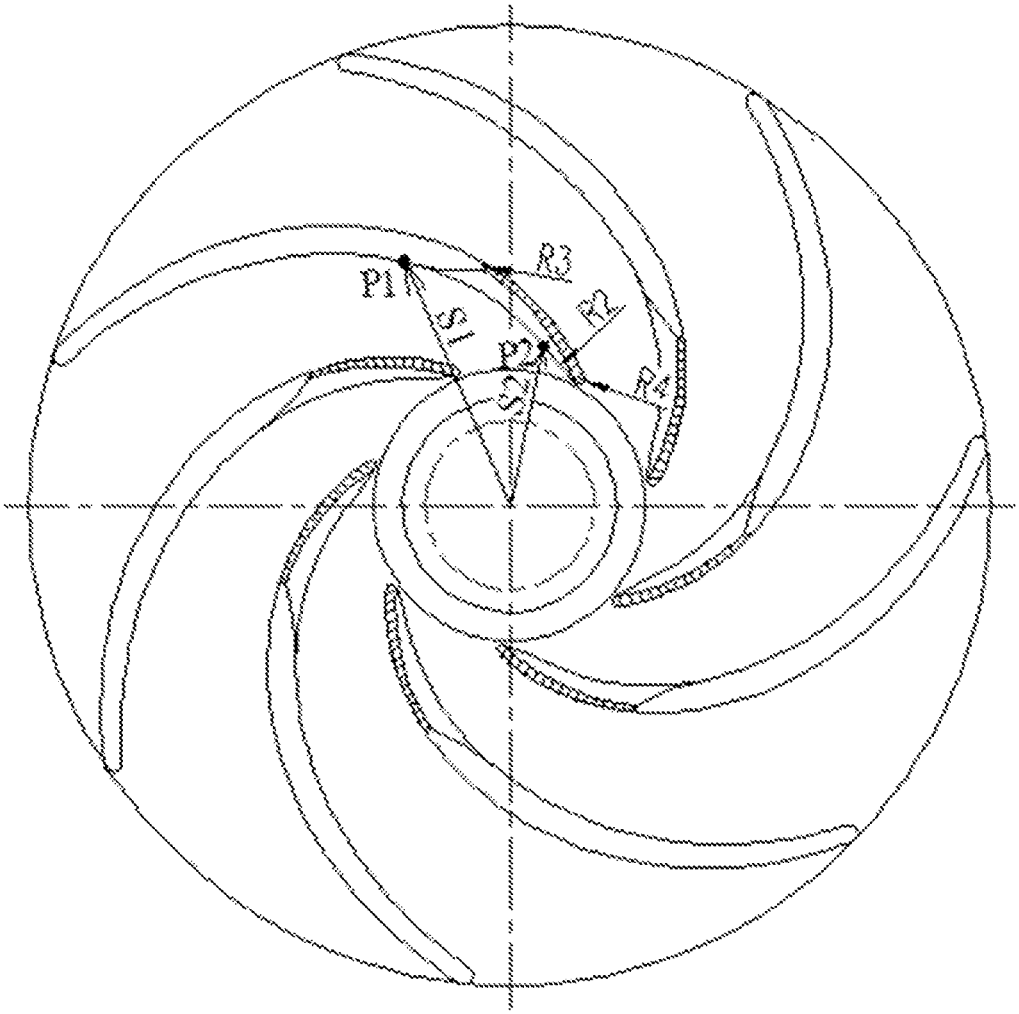
FIG. 3 is a schematic structural diagram of an inlet edge curved surface process using a curved surface processing method for an inlet edge of a cylindrical blade of a centrifugal pump impeller in the present invention.
Figure 4:
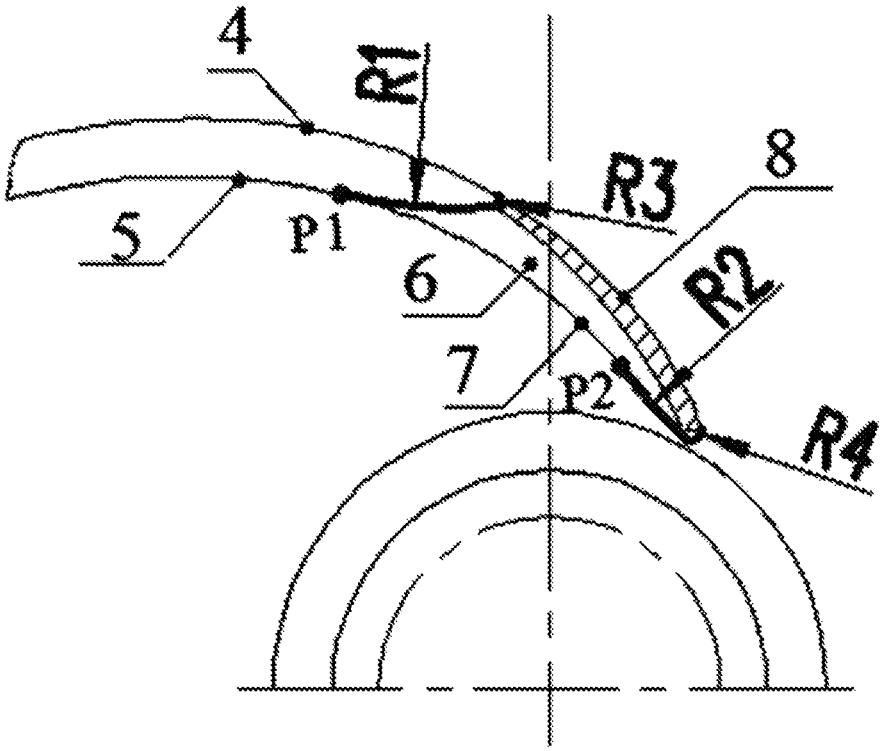
FIG. 4 is an enlarged schematic structural diagram of the inlet edge curved surface process using the curved surface processing method for the inlet edge of the cylindrical blade of the centrifugal pump impeller in the present invention.
Figure 5:
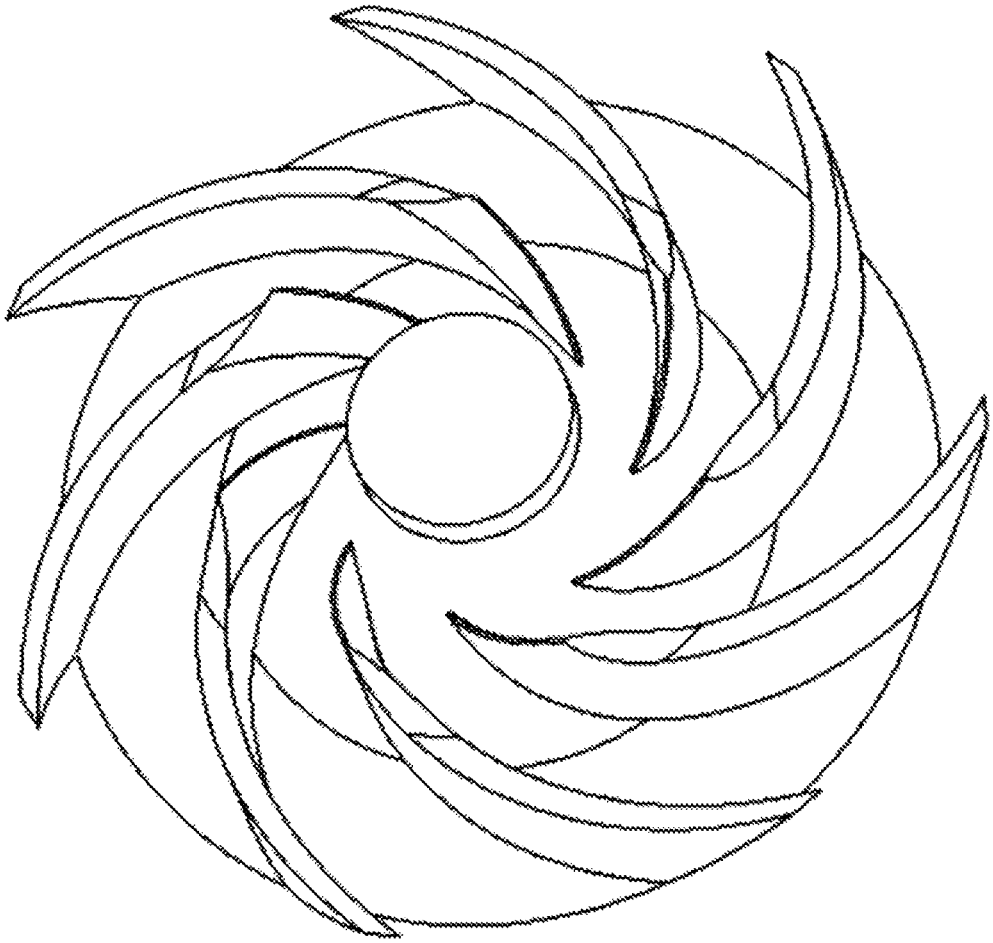
FIG. 5 is a schematic structural diagram of an impeller obtained by the curved surface processing method for the inlet edge of the cylindrical blade of the centrifugal pump impeller in the present invention.

As shown in FIG. 1, this embodiment provides a curved surface processing method for an inlet edge of a cylindrical blade of a centrifugal pump impeller, and the method includes the following steps.

Step 1: A center of an impeller with existing cylindrical blades is used as a center to draw s first circle having a first diameter D1 and a second circle having a second diameter D2. The first circle having the first diameter D1 is an improved inlet position at a top of the blade, and the second circle having the second diameter D2 is an improved inlet position at a bottom of the blade.

Step 2: A first point P1 having a first distance S1 from the center is determined on a concave side curve 5 at the top of the existing cylindrical blade, where the first distance S1=(1.1-1.3)×(D1)/2. A second point P2 having a second distance S2 from the center is determined on a concave side curve 7 at the bottom of the blade, where the second distance S2=(1.1-1.3)× (D2)/2.

Step 3: The concave side curve 5 at the top of the existing cylindrical blade is extended at the first point P1 in a tangential direction to obtain an extended curve and to draw a first arc segment R1, and then draw a third arc segment R3 at which the extended curve is tangent to a convex side curve 4.

Step 4: The concave side curve 7 at the bottom of the existing cylindrical blade is extended at the second point P2 in a tangential direction to obtain an extended curve and to draw a second arc segment R2, and then draw a fourth arc segment R4 at which the extended curve is tangent to the convex side curve 8.

Step 5: Using the third arc segment R3 as a start and the fourth arc segment R4 as an end, an arc surface is used to smoothly transition from the third arc segment R3 to the fourth arc segment R4, to make a radius of the fourth arc segment R4 larger than a radius of the third arc segment R3, thereby forming a draft angle from the bottom to the top.

The principles and implementations of the present invention are described herein through specific examples. The description of the above embodiments is merely provided for ease of understanding of the method and core ideas of the present invention. Those of ordinary skill in the art can make variations and modifications to the present invention in terms of the specific implementations and application scopes according to the ideas of the present invention. Therefore, the specification shall not be construed as limitations to the present invention.

What is claimed is:

1. A curved surface processing method for an inlet edge of a cylindrical blade of a centrifugal pump impeller, comprising the following steps:

step 1: using a center of an impeller with existing cylindrical blades as a center to draw a first circle having a first diameter and a second circle having a second diameter, the first circle having the first diameter being an improved inlet position at a top of the cylindrical blade, and the second circle having the second diameter being an improved inlet position at a bottom of the cylindrical blade;

step 2: determining a first point having a first distance from the center on a concave side curve at the top of the cylindrical blade, and determining a second point having a second distance from the center on a concave side curve at the bottom of the cylindrical blade;

step 3: extending the concave side curve at the top of the cylindrical blade at the first point in a first tangential direction to obtain an extended curve and to draw a first arc segment, and then draw a third arc segment at which the extended curve is tangent to a convex side curve at the top of the cylindrical blade;

step 4: extending the concave side curve at the bottom of the cylindrical blade at the second point in a second tangential direction to obtain an extended curve and to draw a second arc segment, and then draw a fourth arc segment at which the extended curve is tangent to a convex side curve at the bottom of the cylindrical blade; and step 5: smoothly transitioning from the third arc segment to the fourth arc segment with an arc surface using the third arc segment as a start and the fourth arc segment as an end, to make a radius of the fourth arc segment larger than a radius of the third arc segment, and form a draft angle from the bottom of the cylindrical blade to the top of the cylindrical blade.

2. The curved surface processing method for the inlet edge of the cylindrical blade of the centrifugal pump impeller according to claim 1, wherein the first distance=(1.1-1.3)×(D1)/2, wherein D1 is the first diameter.

3. The curved surface processing method for the inlet edge of the cylindrical blade of the centrifugal pump impeller according to claim 1, wherein the second distance=(1.1-1.3)×(D2)/2, wherein D2 is the second diameter.

* * * * *